US008617002B2

(12) United States Patent
Rick

(10) Patent No.: US 8,617,002 B2
(45) Date of Patent: Dec. 31, 2013

(54) WEDGE TYPE GOLF CLUB HEAD WITH IMPROVED PERFORMANCE

(75) Inventor: Helene Rick, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 526 days.

(21) Appl. No.: 12/490,618

(22) Filed: Jun. 24, 2009

(65) Prior Publication Data

US 2010/0331107 A1 Dec. 30, 2010

(51) Int. Cl.
*A63B 53/04* (2006.01)

(52) U.S. Cl.
USPC ..... 473/342; 473/349

(58) Field of Classification Search
USPC ..... 473/324–350
See application file for complete search history.

(56) References Cited

U.S. PATENT DOCUMENTS

| | | | | | |
|---|---|---|---|---|---|
| 732,136 | A * | 6/1903 | Taylor | 473/331 |
| 732,137 | A * | 6/1903 | Taylor | 473/331 |
| 3,847,399 | A * | 11/1974 | Raymont | 473/350 |
| 4,046,944 | A * | 9/1977 | Mueller et al. | 442/94 |
| 4,560,487 | A * | 12/1985 | Brinkley | 428/96 |
| 4,762,322 | A * | 8/1988 | Molitor et al. | 473/345 |
| 4,768,787 | A * | 9/1988 | Shira | 473/331 |
| 5,466,424 | A | 11/1995 | Kusano et al. | |
| 5,500,216 | A | 3/1996 | Julian et al. | |
| 5,516,578 | A * | 5/1996 | Coppens | 442/80 |
| 5,547,427 | A * | 8/1996 | Rigal et al. | 473/345 |
| 5,570,886 | A * | 11/1996 | Rigal et al. | 473/345 |
| 5,885,171 | A | 3/1999 | Sharpe | |
| 6,293,972 | B1 * | 9/2001 | Yamaguchi et al. | 8/116.1 |
| 6,402,636 | B1 * | 6/2002 | Chang | 473/324 |
| 6,419,593 | B1 | 7/2002 | Heinrich et al. | |
| 6,849,004 | B2 * | 2/2005 | Lindsay | 473/330 |
| 6,942,581 | B2 * | 9/2005 | Kim et al. | 473/345 |
| 6,974,392 | B2 * | 12/2005 | Chang | 473/324 |
| 7,086,956 | B2 | 8/2006 | Matthews | |
| 7,186,777 | B2 * | 3/2007 | Wu et al. | 524/765 |
| 2004/0254032 | A1 | 12/2004 | Lutz et al. | |
| 2006/0078724 | A1 * | 4/2006 | Bhushan et al. | 428/323 |
| 2007/0141305 | A1 | 6/2007 | Kasai et al. | |
| 2007/0213143 | A1 | 9/2007 | Chinn et al. | |
| 2007/0237947 | A1 | 10/2007 | Gleason et al. | |
| 2008/0015298 | A1 | 1/2008 | Xiong et al. | |
| 2008/0280699 | A1 | 11/2008 | Jarvholm | |
| 2010/0261538 | A1 * | 10/2010 | Lee | 473/282 |

FOREIGN PATENT DOCUMENTS

| | | | |
|---|---|---|---|
| JP | 02080070 | A * | 3/1990 |
| JP | 06114129 | A * | 4/1994 |
| JP | 10314350 | A * | 12/1998 |
| JP | 11128414 | A * | 5/1999 |
| JP | 2001129135 | A * | 5/2001 |
| JP | 2001327636 | A * | 11/2001 |
| JP | 2004136031 | A * | 5/2004 |

OTHER PUBLICATIONS

Jackson, Jeff. Modern Guide to Golf Clubmaking. Ohio: Dynacraft Golf Products, Inc., copyright 1994, p. 237.*

* cited by examiner

*Primary Examiner* — Alvin Hunter
(74) *Attorney, Agent, or Firm* — Randy K. Chang

(57) ABSTRACT

A wedge type golf club head with improved performance characteristic is disclosed herein where at least a striking surface of the wedge type golf club head is coated with a polymer coating to decrease the coefficient of friction as well as create a hydrophobic surface to remove dirt and debris. More specifically, the present invention discloses a wedge type golf club head with a hydrophobic polymer coating that creates a contact angle of greater than about 90 degrees as well as decreases the coefficient of friction to be less than about 0.1.

17 Claims, 7 Drawing Sheets

WEDGE TYPE GOLF CLUB HEAD WITH IMPROVED PERFORMANCE

FIELD OF THE INVENTION

The present invention relates generally to a wedge type golf club head having improved performance characteristics. More specifically, the present invention relates to a wedge type golf club head with a polymer coating that decreases the coefficient of friction to create more spin as well as offer hydrophobic properties to shed water and debris. Even more specifically, the present invention relates to a wedge type golf club head with a hydrophobic polymer coating that increases the contact angle of the striking surface to be greater than about 90 degrees as well as decreases the coefficient of friction of the same striking surface to be less than about 0.1.

BACKGROUND OF THE INVENTION

Wedge type golf clubs are generally a specific type of golf club head with an increased loft angle to allow a golfer to execute a short ranged golf shot with improved trajectory, accuracy, and control. This increased loft angle in the wedge type golf club generally yields a golf shot with a higher trajectory because the impact surface is at an inclination, allowing a golf ball to move up along the inclination of the wedge as it strikes a golf ball. Due to this increased inclination, the golf ball leaving the wedge type golf club head may generally have a backwards rotation more commonly known as "backspin" within the golf industry. Backspin on a golf ball being struck by a higher lofted wedge type golf club head may generally be a desirable trait as it generally increase the trajectory, accuracy, and control of a golf shot.

Backspin helps improve trajectory, accuracy, and control of a golf shot by giving the golf ball a gyroscopic effect, which stabilizes ball flight, hence increasing accuracy. Moreover, backspin also serves to increase control of a golf shot as backspin minimizes the roll of a golf ball after landing, creating a more predictable golf shot after it lands on the ground. One of the most common way to impart spin on a golf ball struck by a wedge type golf club head is to utilize a plurality of one or more grooves placed horizontally across the striking surface of the wedge type golf club head capturing a golf ball as the golf ball slides upward along the striking surface of the wedge type golf club head, thus creating backspin.

In addition to utilizing a plurality of one or more grooves, additional methods to increase the amount of backspin on a golf shot executed using a wedge type golf club head include increasing the coefficient of friction on the striking surface of the wedge type golf club head. For example, U.S. Pat. No. 4,768,787 to Shira titled Golf Club Including High Friction Striking Face ('787 patent) discloses a golf club provided with a metallic golf ball striking surface wherein the striking surface has hard particles embedded therein with portions of the particles protruding above the surface so as to provide greater frictional grip between the golf ball striking surface and the golf ball.

U.S. Patent Publication No. 2004/0254032 to Lutz et al. titled Golf Ball Having High Surface Friction ('023 patent Publication) provides an alternative solution to the '787 patent by disclosing a golf ball with an increased coefficient of friction instead of a golf club with the increased coefficient of friction. The '032 patent Publication discloses a golf ball comprising a core and a cover, wherein an outermost surface of the golf ball has a coefficient of friction of greater than 0.6.

As can be seen from above, the current practice in the art increases the coefficient of friction in an attempt to increase spin. However, increasing the coefficient of friction might not maximize the amount of spin achievable in a wedge type golf club; as increasing the coefficient of friction between a golf club and a golf ball decreases the distance that a ball may slide up the wedge type golf club head. In an alternative approach to maximizing spin, it may be desirable to create a low coefficient of friction between the wedge type golf club head and the golf ball instead of increasing the coefficient of friction. Lowering the coefficient of friction allows the golf ball to travel further up the surface of the wedge as it is struck by the wedge. Despite the fact that lowering the coefficient of friction between the wedge type golf club head and the golf ball seems to contradict the conventional methodology shown above, the fact that the golf ball is allowed to travel further up the surface of the wedge club head increases the number of grooves the ball may come into contact with, resulting in an increase in the total amount of backspin that may be generated by the horizontal grooves.

Another important performance characteristic in a wedge besides spin is the ability to create a solid contact between the wedge type golf club head and a golf ball. In order to create solid contact, it may generally be desirable to keep the face of the wedge free of any water and debris. Wedge type golf club heads, being a versatile scoring clubs with improved trajectory, accuracy, and control are often used to hit a golf ball that land in the rough areas of the golf course. Rough areas may tend to generally have longer grass that could attract and retain moisture and debris, making shots out of the rough more difficult. Because wedge performance relies on the quality of contact between the wedge and the golf ball, it is important for a wedge to have sufficient ability to tread through the rough grass areas of a golf course while removing the water and the debris that could interfere with the quality of contact between a wedge type golf club head and a golf ball. In order to help shed water and debris, numerous methods have been used to apply a water repellant and self cleaning coating onto golf balls that may be hydrophobic or superhydrophobic.

U.S. Patent Publication No. 2008/0280699 by Jarvholm entitled Water Repellant Golf Balls Containing a Hydrophobic or Superhydrophobic outer layer or coating ('699 patent Publication) discloses a water-repellant, self-cleaning coatings and methods of making and using thereof. In one embodiment, a hydrophobic or superhydrohphibic coating is applied to the surface of a golf ball to make the golf-ball water-repellant and self-cleaning.

Alternatively, U.S. Pat. No. 7,086,956 by Matthews entitled Apparatus and Method for Recording the Impact Location Between a Golf Ball and a Golf Club ('956 patent) discloses an apparatus and method for recording an impact location between a golf ball and a golf club wherein the recording member is treated by chemical or other means to increase its water or moisture repellence.

It can be seen from above that neither of the cited reference sufficiently provide a way to create a wedge type golf club head with hydrophobic properties that allow moisture and debris to be shed from the face of the wedge type golf club head. Having a hydrophobic coating on a golf ball is different from having a hydrophobic coating on a wedge, as the golf ball may generally remain static and the wedge type golf club is the one moving with speed and momentum. Hence it can be seen there is a need in the field for a wedge type golf club head with a coating on at least the striking surface that decreases the coefficient of friction to create more spin as well as offer hydrophobic properties.

BRIEF SUMMARY OF THE INVENTION

In one aspect of the present invention is a wedge type golf club head comprising of a forward portion and an aft portion.

The forward portion of the wedge type golf club head is further comprised of a striking surface for striking a golf ball, a plurality of grooves that are placed horizontally across the striking surface and a polymer coating covering at least the striking surface of the wedge type golf club head. The wedge type golf club head in accordance with the present invention may generally have a loft angle of greater than about 45 degrees and the polymer coating has a hydrophobic coefficient of friction ratio of less than about 0.001; wherein the hydrophobic coefficient of friction ratio is defined as a ratio of the coefficient of friction of the polymer coating divided by a contact angle of the polymer coating.

In another aspect of the present invention is a method of creating a wedge type golf club head with improved performance comprising of the steps of coating at least a striking surface of the wedge type golf club head with a polymer coating, wherein the wedge type golf club head has a loft angle of greater than about 45 degrees. Moreover, the polymer coating used to coat the striking surface of the wedge type golf club head may generally have a hydrophobic coefficient of friction ratio of less than about 0.001; wherein the hydrophobic coefficient of friction ratio is defined as a ratio of the coefficient of friction of the polymer coating divided by a contact angle of the polymer coating.

In a further aspect of the present invention is a wedge type golf club head comprising of a forward portion and an aft portion. The forward portion of the wedge type golf club head is further comprised of a striking surface for striking a golf ball, a plurality of grooves that are placed horizontally across the striking surface and a polymer coating covering at least the striking surface of the wedge type golf club head. The wedge type golf club head in accordance with the present invention may generally have a loft angle of greater than about 45 degrees and the polymer coating modifies the striking surface to have a contact angle of greater than about 90 degrees and a coefficient of friction of less than about 0.1.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
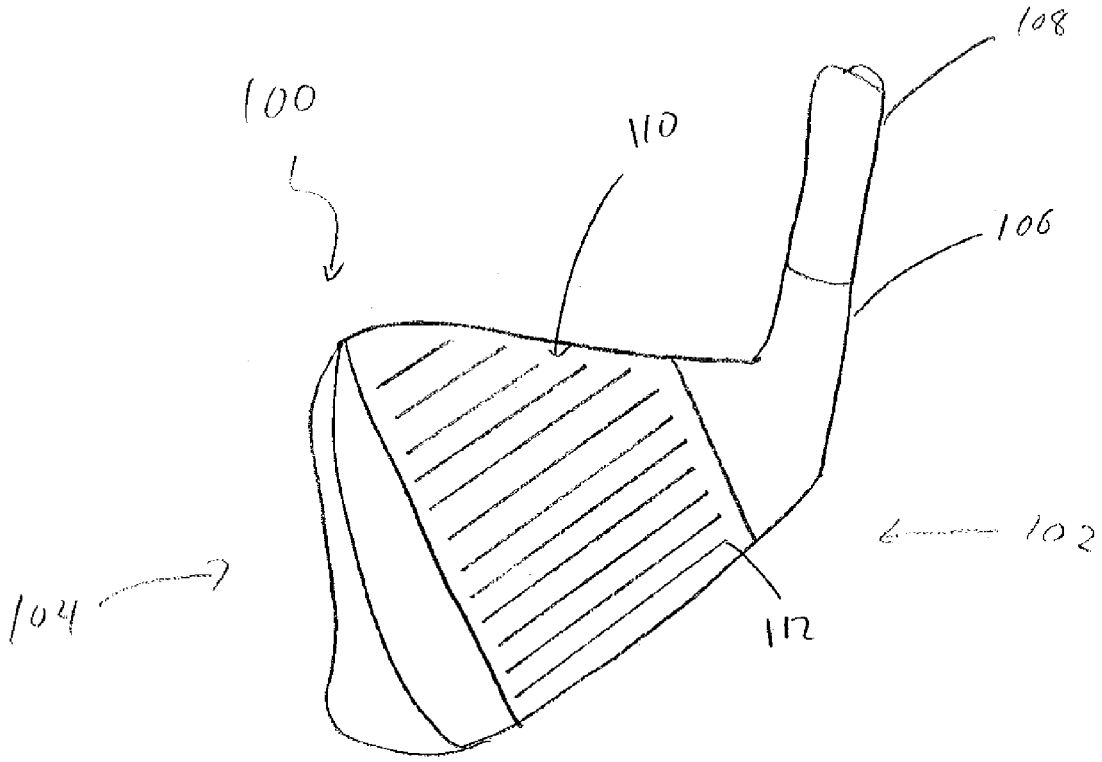
FIG. 1 shows a perspective view of a wedge type golf club head in accordance with the present invention.

Turning now to FIG. 1 showing a perspective view of a wedge type golf club head 100 in accordance with an exemplary embodiment of the present invention. Wedge type golf club head 100 may generally be comprised of a forward portion 102, an aft portion 104, and a hosel 106 connecting a shaft 108 to the golf club head 100. The forward portion 102 may be further comprised of a striking surface 110 containing a plurality of grooves 112 that helps with imparting spin of a golf ball that is struck with the wedge type golf club head 100. In the current exemplary embodiment of the present invention, the striking surface 110 of the current invention may be coated with a polymer that may decrease the coefficient of friction of the striking surface 110 to less than about 0.1 as well as offer hydrophobic properties that generates a contact angel of greater than about 90 degrees.

Figure 2:
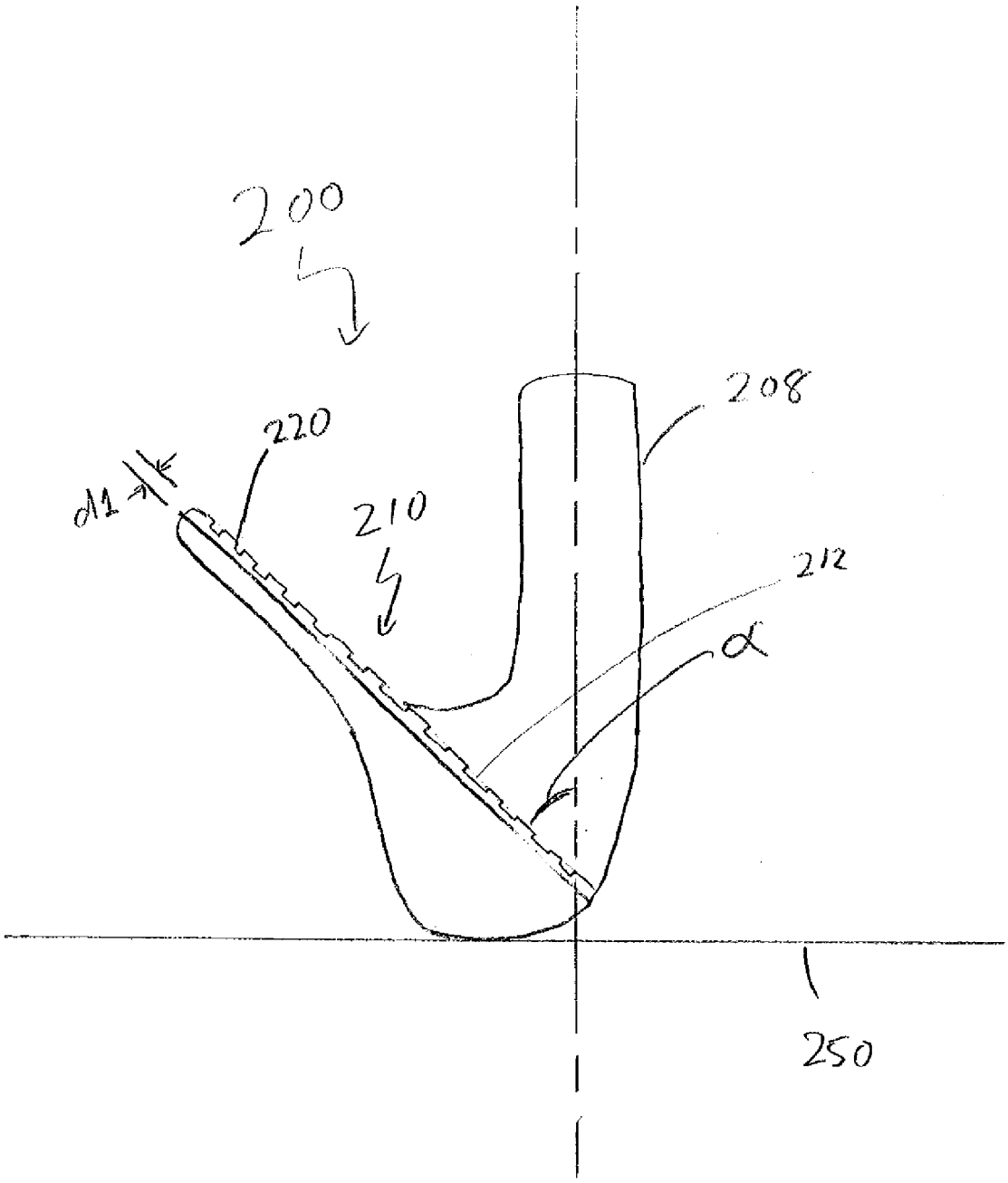
FIG. 2 shows a side view of the wedge type golf club head showing a polymer coating.

FIG. 2 shows a side view of wedge type golf club head 200 providing a clearer view of the polymer coating 220 on the striking surface 210. Polymer coating 220, as shown in the current exemplary embodiment, may generally have a thickness d1 measured from the striking surface 210 of the wedge type golf club head 200. Thickness d1, as shown in the current exemplary embodiment, may generally be between about 100 microns to about 1000 microns thick, more preferably between about 300 microns to about 700 microns thick, most preferably about 500 microns thick. Although FIG. 2 shows the polymer coating 220 having a uniform thickness d1 across the entire striking surface 210, polymer coating 220 may take on other profiles such as a variable thickness profile, a gradually increasing thickness profile, a gradually decreasing profile, or any random uneven polymer coating 220 profile all without departing from the scope and content of the present invention.

Side view of the wedge type golf club head 200 also shows the wedge type golf club head having a loft angle $\alpha$ depicting the angle of the striking surface 200 relative to a vertical plane that is perpendicular to the ground 250 passing through the hosel 208 of the wedge type golf club head 200. Loft angle $\alpha$ of a wedge type club head 200 may generally be higher compared to other types of golf club heads due to their need to perform accurate shots having a higher trajectory. Loft angle $\alpha$, as shown in the current exemplary embodiment, may generally be greater than about 40 degrees, more preferably greater than about 43 degrees, and more preferably greater than 45 degrees.

Polymer coating 220, as shown in the current exemplary embodiment, may generally be comprised of a material that creates a hydrophobic coating on the striking surface 210 of the wedge type golf club head 200. The hydrophobic polymer coating 220 may generally be of a flurochemical or silicone treatments on structured surfaces with or without micro-scaled particulates. More specifically, the polymer coating may refer to oligomers, adducts, homopolymers, random copolymers, pseudo-co-polymers, statistical copolymers, alternating copolymers, periodic copolymer, bipolymers, ter-polymers, quaterpolymers, other forms of copolymers, substituted derivatives thereof, and combinations of two or more thereof. These polymers can be linear, branched, block, graft, monodisperse, polydisperse, regular, irregular, tactic, isotactic, syndiotactic, stereoregular, atactic, stercoblock, single-strand, double-strand, star, comb, dendritic, and/or ionomeric. Finally it should be noted that the polymer coating 220 could be comprised of nano-suspension compounds of various hardeners without departing from the scope and content of the present invention.

Figure 3:
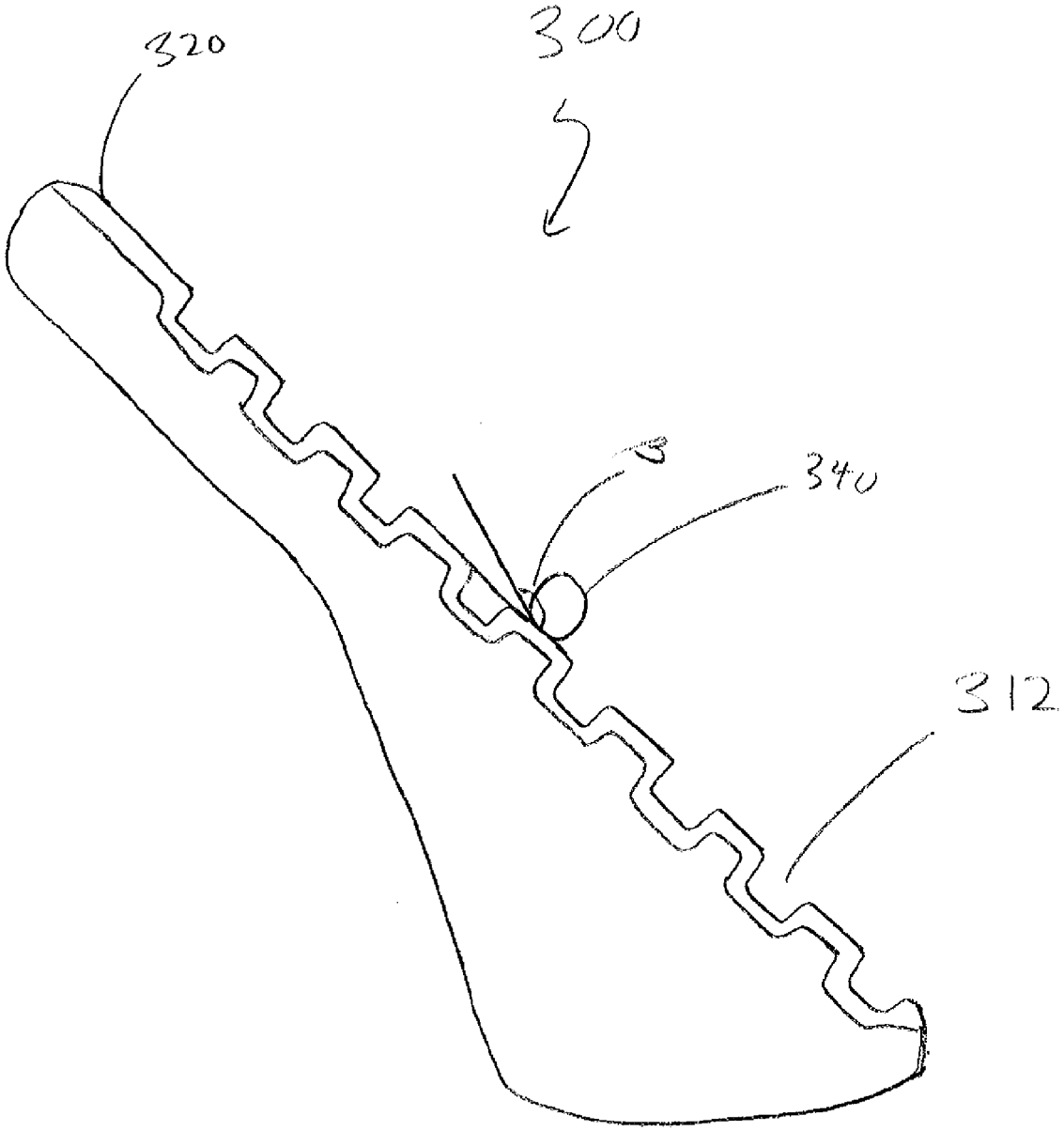
FIG. 3 shows an enlarged side view of the wedge type golf club head allowing a water droplet to be shown on top of the polymer coating.

FIG. 3 provides a close up view of wedge type golf club head 300 containing a plurality of grooves 312 demonstrating the hydrophobic effect of the polymer coating 320 as it interacts with a water droplet 340 creating a contact angle β. Hydrophobic polymer coating 320, as shown in the current embodiment, may generally create a contact angle β that is greater than 90 degrees, more preferably greater than 100 degrees, and most preferably greater than 120 degrees to create a hydrophobic effect within the scope and content of the present invention. Contact angle β, as shown in the current exemplary embodiment, generally refers to the angle at which a liquid interfaces with a solid surface. This contact angle β may generally be defined by the boundary conditions of a liquid through Young's Equation.

Figure 4:
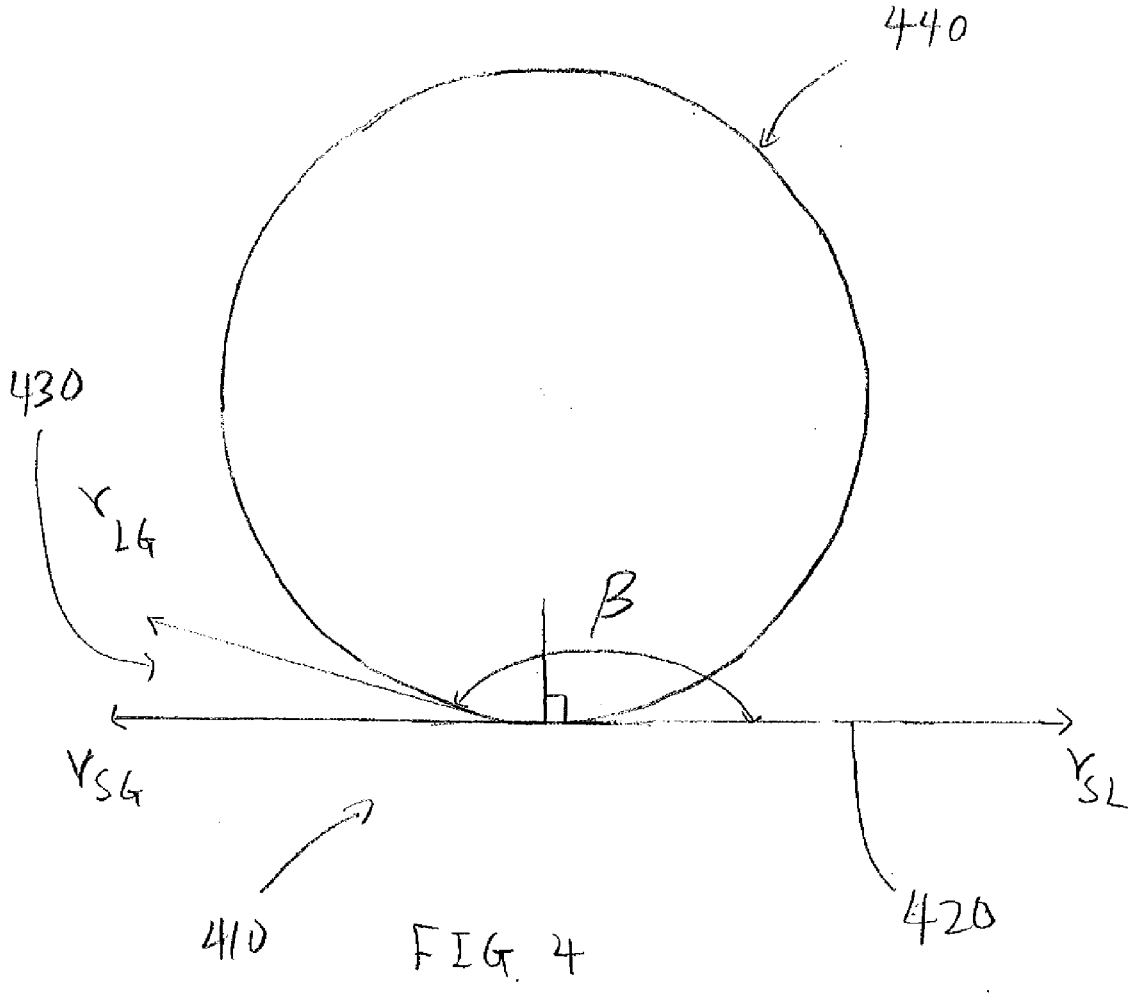
FIG. 4 shows an even further enlarged side view of the wedge type golf club head showing the forces involved between the water droplet and the polymer coating.

Young's Equation takes in consideration of the forces acting on a liquid droplet resting on a solid surface surrounded by a gas. FIG. 4 shows an enlarged representation of the forces acting on a liquid droplet resting on a solid surface surrounded by gas depicted by the three components, namely a liquid droplet 440, a hydrophobic polymer coating 420 underneath the liquid droplet 440, and an ambient gas 430 surrounding the liquid droplet 440. In order to quantify the relationships below, various force vectors are shown in FIG. 4 to represent the interfacial tension between the various components in equilibrium. Equation (1) below depicts their relationship in creating equilibrium.

$$0=\gamma_{SV}-\gamma_{SL}-\gamma_{LG}\cos\beta \quad \text{(Eq. 1)}$$

where $\gamma_{SG}$=Interfacial Tension between polymer coating 420 and gas 430

$\gamma_{SL}$=Interfacial Tension between polymer coating 420 and liquid droplet 440

$\gamma_{LG}$=Interfacial Tension between liquid droplet 440 and gas 430

As Equation (1) above shows, at resting state, the thermodynamic equilibrium achieved between the polymer coating 420, the gas 430, and the liquid droplet 440 equals to zero. Because $\gamma_{LG}$ is positioned at an angle, the angle between the polymer coating 420 and the liquid droplet 440 can be accurately described as the contact angle β, which define the hydrophobicity of the polymer coating 420. As mentioned above, polymer coating 420 may generally yield a contact angle β greater than 90 degrees, more preferably greater than 100 degrees, and most preferably greater than 120 degrees all within the scope and content of the present invention.

Wedge type golf club head, due to its hydrophobic polymer coating 420, may also serve a self cleaning purpose by picking up any dirt or debris as the liquid droplet 440 is shed away from the striking surface 410. This self cleaning process generally occurs due to the hydrophobicity of the polymer coating 420 allowing water droplet 440 to glide across the surface of the striking surface 410 that has a high contact angle β, taking along with it moisture and debris.

Figure 5:
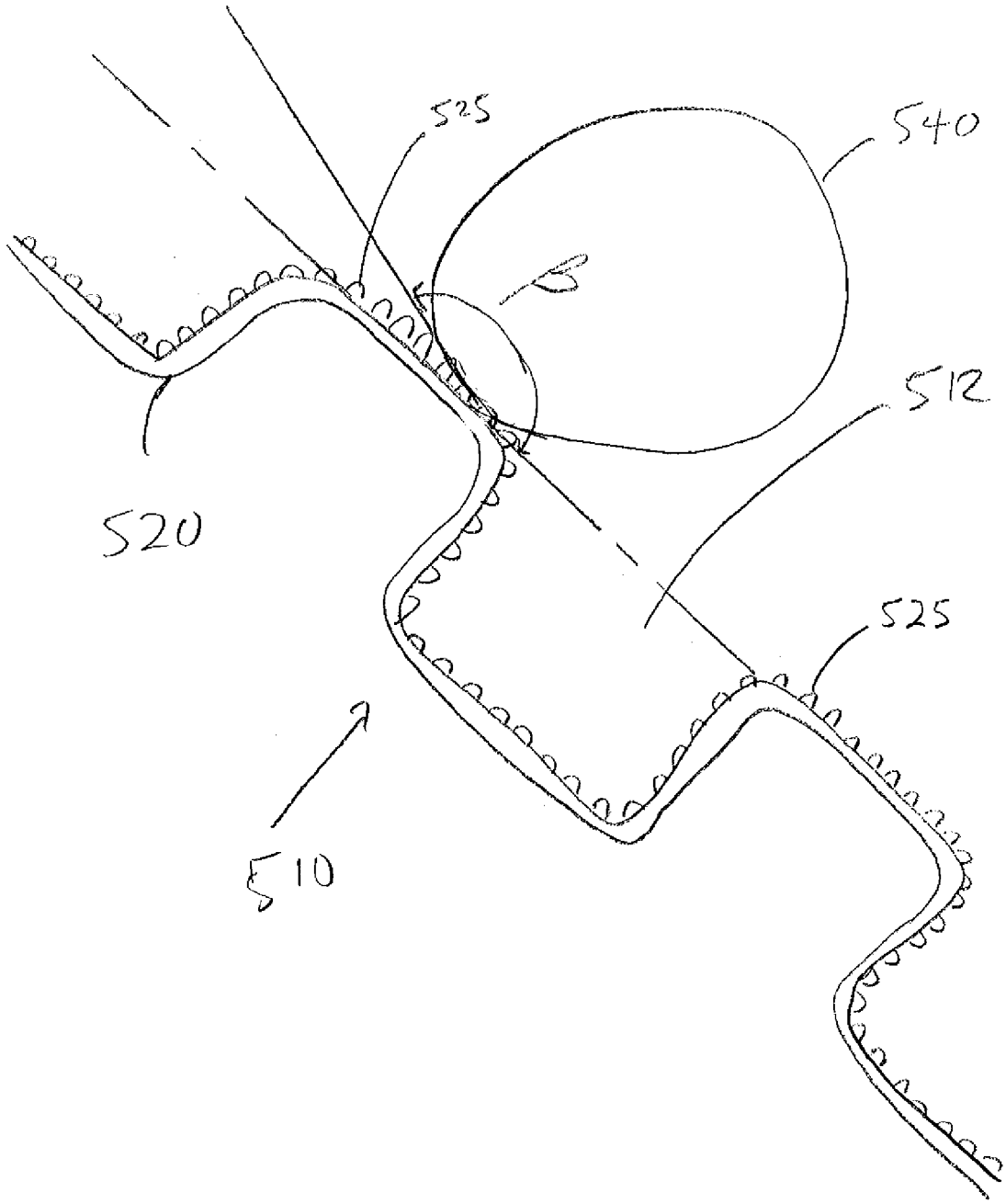
FIG. 5 shows an enlarged side view of an alternative embodiment of the wedge type golf club head containing a plurality of microscopic papillae.

FIG. 5 shows an enlarged view of the plurality of grooves 512 in accordance with an alternative embodiment of the present invention, wherein the polymer coating 520 may exhibit an uneven hydrophobic surface containing a plurality of microscopic papillae 525. The plurality of microscopic papillae 525 may serve to further enhance the hydrophobic effect of the polymer coating 520 similar to that of a lotus leaf. This plurality of microscopic papillae 525 increasing the hydrophobic effect of the polymer coating 520 may also be known as the "lotus effect" because of its resemblance to the physical structure of a lotus leaf. Lotus leafs, despite growing in muddy rivers and lakes, have a unique ability to remain clean and dry due to its super hydrophobic properties that could be partially attributed to the microscopic papillae across its surface. This unique ability of the lotus leafs to achieve a superhydrophobic surface layer may result in a surface contact angle of greater than about 150 degrees and even up to about 170 degrees causing extremely high surface tension between the polymer coating 520 and the liquid droplet 540.

The plurality of microscopic papillae 525, as shown in the alternative exemplary embodiment in FIG. 5, may generally help the polymer coating 520 achieve a higher contact angle β by increasing the surface tension occurring between the liquid droplet 540 and the striking surface 510. It should also be noted that the plurality of microscopic papillae 525 resembling a lotus affect may further help remove debris from the surface of the striking surface 510 by allowing the liquid droplet 540 to have a greater contact angle β, thus forming a bigger bead of water and picking up more debris as it gets shed away from the striking surface 520.

Turning back to FIG. 2 showing the side view of a wedge type golf club head 200 in accordance with an exemplary embodiment of the present invention, it should be noted that in addition to the hydrophobic properties, the polymer coating 220 shown in the current exemplary embodiment may also provide a low coefficient of friction to further enhance the performance characteristic of the wedge type golf club head 200. The performance characteristic of a wedge type golf club head 200 may be partially attributed to the amount of backspin it can impart of a golf ball, as more backspin usually yields in a more predictable roll distance after a golf ball lands. This polymer coating 220 containing a low coefficient of friction may generally help minimize the spin losses of a wedge type golf club head 200 in two ways. First and foremost, the polymer coating 220 decreasing the coefficient of friction may allow a golf ball to travel further up the face allowing the ball to come in to contact with more of the plurality of grooves 212. Secondly, the polymer coating 220 that decreases the coefficient of friction may also help decrease spin loss by reducing the friction between the striking surface 210 and a golf ball, minimizing the amount of spin that may be lost as the ball leaves the face.

Figure 6:
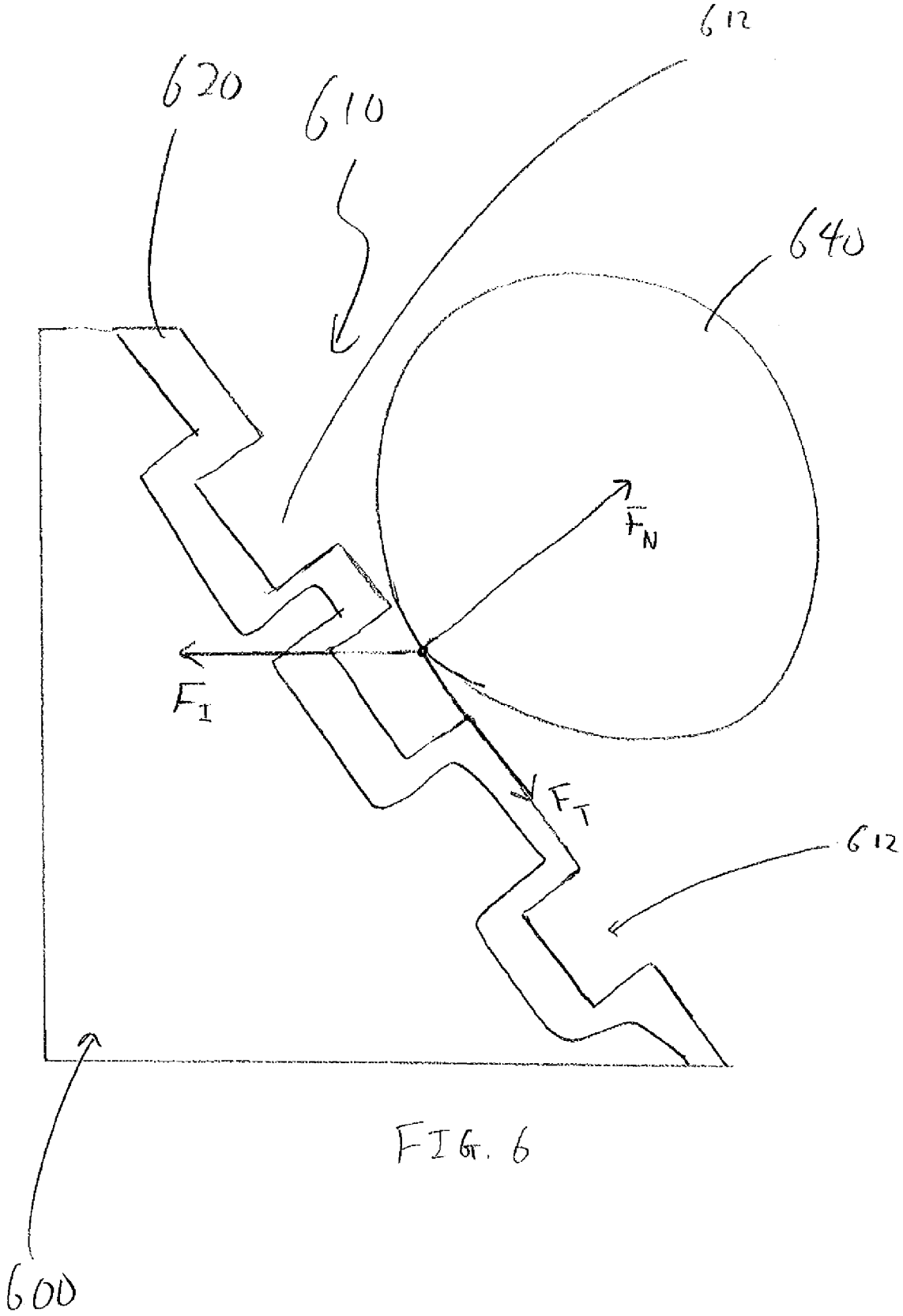
FIG. 6 shows an enlarged side view of the wedge type golf club head showing the forces involved between a golf ball and the striking surface of the wedge type golf club head.

FIG. 6 showing an enlarged side view of the striking surface 610 of the wedge type golf club head 600 allowing a clearer view of the forces involved when a golf ball 640 impacts a wedge type golf club head 600 having a ultra low coefficient polymer coating 620. More specifically, FIG. 6 shows an impact force $F_I$, and the two reactionary forces, a normal force $F_N$ and a tangential force $F_T$. Normal force $F_N$ may generally refer to the part of the reaction force to the golf ball 640 that is normal to the loft angle of the wedge type golf club head 600. This normal force $F_N$ may generally depict the amount of energy that governs the launch angle and speed of the golf ball 640 coming away from the striking surface 610 of the wedge type golf club head 600. Tangential force $F_T$, on the other hand, may generally refer to the other component of the reactionary force to the golf ball 640 that is tangent to the loft angle of the wedge type golf club head 600. This tangential force $F_T$ may generally depict the amount of energy impairing the golf ball from sliding along the striking surface 610 of the wedge type golf club head 600. The relationship between the impact force $F_I$, the normal force $F_N$, and the tangential force $F_T$ may be better captured utilizing Equation (2) below:

$$F_I = F_N + F_T \quad \text{(Eq. 2)}$$

As it can be seen from FIG. 6, the three force balance each other out after taken in consideration the different direction of the forces as they are presented in FIG. 6. Looking in more detail the right side of Equation (2) above, we can further define a relationship that defines the coefficient of friction μ as a relationship of the tangential force $F_T$ and the normal force $F_N$ illustrated below as Equation (3):

$$\mu = \frac{F_T}{F_N} \quad \text{(Eq. 3)}$$

where μ=coefficient of friction

Coefficient of friction μ, defined as the tangential force $F_T$ over the normal force $F_N$ above in Equation (3), may generally decrease the distance a golf ball 640 may travel up the striking surface 610 of the wedge type golf club head 600. Consequently, if the coefficient of friction μ is lowered, the golf ball 640 is allowed to travel more freely up the striking surface 610 of the wedge type golf club head. This greater travel distance may generally allow the golf ball 640 to come in contact with more of the plurality of grooves 612 that are on the striking surface 610 of the wedge type golf club head 600 for the purpose of imparting additional spin.

In addition to allowing a golf ball 640 to encounter more of the spin inducing plurality of grooves 612, the lowered coefficient of friction μ of the polymer coating 620 also serves to maintain the existing spin on a golf ball 640. As it can be seen in FIG. 6, a golf ball 640 traveling up the striking surface 610 of the wedge type club head 600 will pick up a backwards rotational spin. A lowered coefficient of friction μ, will allow the golf ball 640 to slide up the striking surface 610 while minimizing the loss in that spin that has already been generated. The polymer coating 620 that creates this lowered coefficient of friction μ may generally have a coefficient of friction less than about 0.1, more preferably less than about 0.08, and most preferably lesser than about 0.04.

It should be noted that the polymer coating 620 that is capable of yielding a striking surface 610 having a lowered coefficient of friction μ of less than about 0.1 combined with a hydrophobic surface having a contact angle β of greater than about 90 degrees may yield a "Hydrophobic Coefficient of Friction Ratio" of less than about 0.005, more preferably less than about 0.002, and most preferably less than about 0.001; wherein this hydrophobic coefficient of friction ratio is defined by the coefficient of friction μ divided by the contact angle β defined below as Equation (4):

$$\text{Hydrophobic Coefficient of Friction Ratio} = \frac{\text{Coefficient of Friction } \mu}{\text{Contact Angle } \beta} \quad \text{(Eq. 4)}$$

This "Hydrophobic Coefficient of Friction Ratio" may generally yield a ratio of the two most important characteristics of the polymer coating 620, and it defines the performance characteristics of the wedge type golf club head 600 relating to the backspin and hydrophobic capabilities of the wedge type golf club head 600.

In accordance with a further embodiment of the present invention, a wedge type golf club head 600 may utilize different Hydrophobic Coefficient of Friction Ratios to match with different loft angle α (shown in FIG. 2); as different wedge type golf club heads 600 having different loft angles α (shown in FIG. 2) may require different Hydrophobic Coefficient of Friction Ratios to optimize performance. A wedge having a higher loft angle α (shown in FIG. 2) may generally require less coefficient of friction μ to generate more spin, thus creating a gradual decrease in coefficient of friction μ as the wedge loft a increases. Additionally, a wedge having a higher loft angle α (shown in FIG. 2) may also require a higher contact angle β creating a more hydrophobic surface to combine with the decreased coefficient of friction μ to work in conjunction with the loft angle α.

In one embodiment of the present invention, a wedge type golf club head 600 having a loft angle α of between about 45 degrees to about 50 degrees may generally yield a contact angle β of greater than about 90 degrees with a coefficient of friction μ of less than about 0.025 yielding a Hydrophobic Coefficient of Friction Ratio of less than about 0.0003. In another embodiment of the present invention, a wedge type golf club head 600 having a loft angle α of between about 50 degrees to about 55 degrees may generally yield a contact angle β of greater than about 95 degrees with a coefficient of friction μ of less than about 0.050 yielding a Hydrophobic Coefficient of Friction Ratio of less than about 0.0005. In a further alternative embodiment of the present invention, a wedge type golf club head 600 having a loft angle α of between about 50 degrees to about 60 degrees may generally yield a contact angle β of greater than about 100 degrees with a coefficient of friction μ of less than about 0.075 yielding a Hydrophobic Coefficient of Friction Ratio of less than about 0.00075. Finally, in an even further alternative embodiment of the present invention, a wedge type golf club head 600 having a loft angle α of greater than about 60 degrees may generally yield a contact angle β of greater than about 105 degrees with a coefficient of friction μ of less than about 0.1 yielding a Hydrophobic Coefficient of Friction Ratio of less than about 0.0009. In summary, a wedge type golf club head 600 with a higher loft angle α will generally yield a higher contact angle β combined with a higher coefficient of friction μ to maximize performance.

Figure 7:
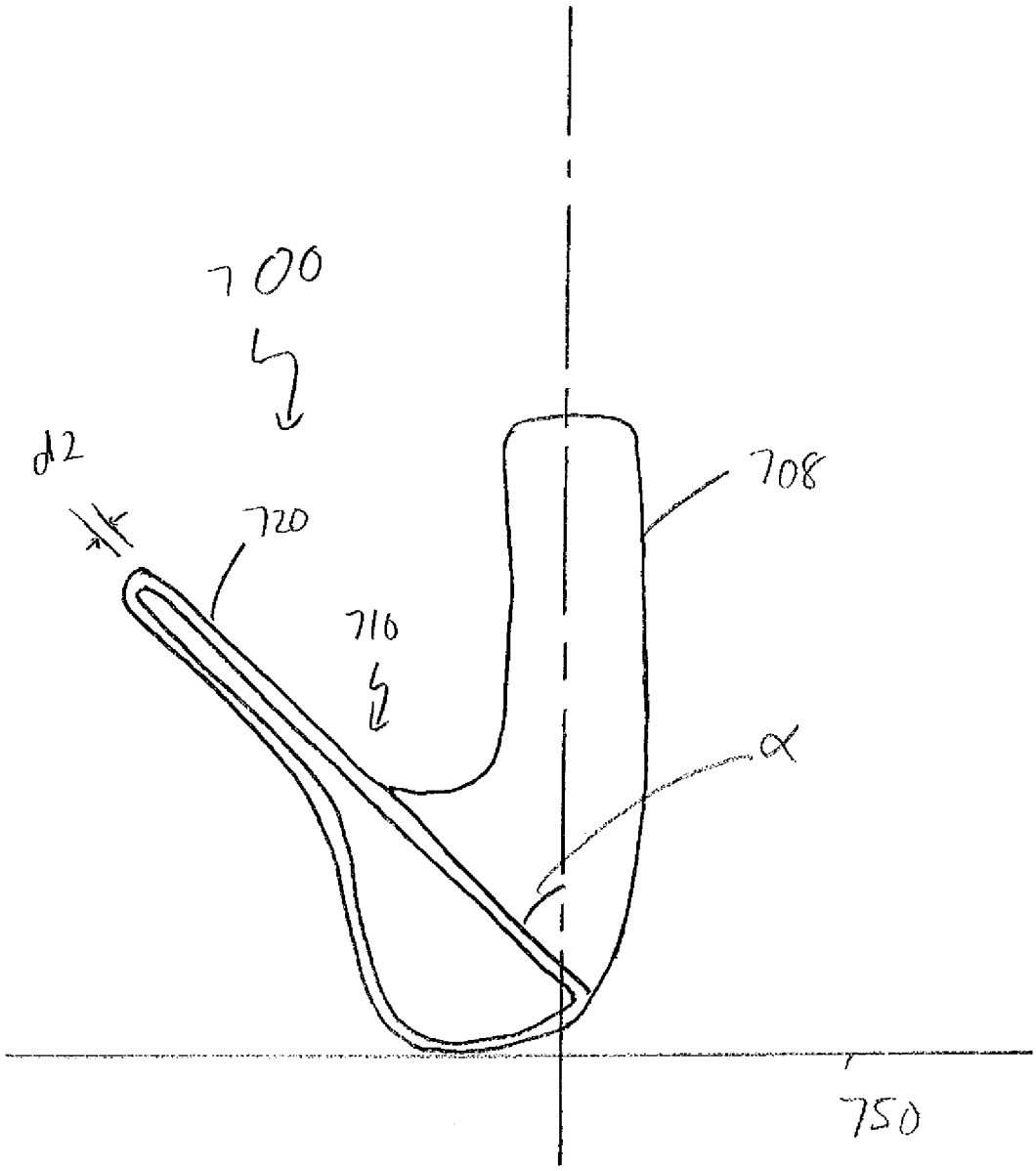
FIG. 7 shows a side view of an alternative embodiment of a wedge type golf club head in accordance with the present invention.

FIG. 7 shows a further alternative embodiment of the present invention wherein the polymer coating 720 may cover the entire exterior area of the wedge type golf club head 700 instead of just the striking surface 710. Wedge type golf club head 700 may be covered entirely with the polymer coating 720 for various other reasons other than the performance benefits within the striking surface 710 as described above. Various other reasons for coating the entire wedge type golf club head 700 may include aesthetic uniformity as well as cleanliness of the entire wedge type golf club head 700 to name a few. The polymer coating 720, as shown in the current exemplary embodiment in FIG. 7, may be a coating that has a thickness d2. Thickness d2, as shown in this current alternative embodiment may be from about 100 microns to about 1000 microns, more preferably between from about 300 microns to about 700 microns, most preferably about 500 microns.

Other than in the operating example, or unless otherwise expressly specified, all of the numerical ranges, amounts, values and percentages such as those for amounts of materials, moment of inertias, center of gravity locations, loft, draft angles, various performance ratios, and others in the following portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A wedge type golf club head comprising:
a forward portion, and
an aft portion,
wherein said forward portion further comprises,
a striking surface for striking a golf ball,
a plurality of grooves placed horizontally across said striking surface, and
a polymer coating covering at least said striking surface,
wherein said polymer coating has a thickness of from about 300 microns to about 700 microns,
wherein said wedge type golf club head has a loft angle of greater than about 45 degrees,
wherein said polymer coating has a hydrophobic coefficient of friction ratio of less than about 0.001, and
wherein said hydrophobic coefficient of friction ratio is defined as a ratio of a coefficient of friction of said polymer coating divided by a contact angle of said polymer coating.

2. The wedge type golf club head of claim 1, wherein said contact angle is greater than about 90 degrees.

3. The wedge type golf club head of claim 2, wherein said coefficient of friction is less than about 0.1.

4. The wedge type golf club head of claim 3, wherein said polymer coating only covers said striking surface.

5. The wedge type golf club head of claim 3, wherein said polymer coating is further comprised of a plurality of microscopic papillae.

6. The wedge type golf club head of claim 3, wherein said contact angle is greater than about 120 degrees.

7. The wedge type golf club head of 3, wherein said coefficient of friction is less than about 0.08.

8. The wedge type golf club head of claim 3, wherein said hydrophobic coefficient of friction ratio decreases with the increase of said loft angle of said wedge type golf club head.

9. The wedge type golf club head of claim 8, wherein said contact angle increases positively with the increase of said loft angle of said wedge type golf club head.

10. The wedge type golf club head of claim 8, wherein said coefficient of friction increases positively with the increase of said loft angle of said wedge type golf club head.

11. A method of creating a wedge type golf club head with improved performance comprising:
coating at least a striking surface of said wedge type golf club head with a polymer coating,
wherein said wedge type golf club head has a loft angle of greater than about 45 degrees,
wherein said polymer coating has a thickness of from about 300 microns to about 700 microns,
wherein said polymer coating has a hydrophobic coefficient of friction ratio of less than about 0.001, and
wherein said hydrophobic coefficient of friction ratio is defined as a ratio of a coefficient of friction of said polymer coating divided by a contact angle of said polymer coating.

12. The method of creating a wedge type golf club head with improved performance of claim 11, wherein said contact angle is greater than about 90 degrees.

13. The method of creating a wedge type golf club head with improved performance of claim 12, wherein said coefficient of friction is less than about 0.1.

14. A wedge type golf club head comprising:
a forward portion, and
an aft portion;
wherein said forward portion further comprises,
a striking surface for striking a golf ball,
a plurality of grooves placed horizontally across said striking surface, and
a polymer coating covering at least said striking surface,
wherein said wedge type golf club head has a loft angle of greater than about 45 degrees,
wherein said polymer coating has a thickness of from about 300 microns to about 700 microns,
wherein said polymer coating modifies said striking surface to have a contact angle of greater than about 90 degrees, and
wherein said polymer coating modifies said striking surface to have a coefficient of friction of less than about 0.1.

15. The wedge type golf club head of claim 14, wherein said contact angle increases positively with the increase of said loft angle of said wedge type golf club head.

16. The wedge type golf club head of claim 14, wherein said coefficient of friction increases positively with the increase of said loft angle of said wedge type golf club head.

17. The wedge type golf club head of claim 14, wherein said polymer coating is further comprised of a plurality of microscopic papillae.

* * * * *